US005135263A

United States Patent [19]

Terwel

[11] Patent Number: 5,135,263

[45] Date of Patent: Aug. 4, 1992

[54] LAMINATED IDENTITY CARD AND A METHOD FOR THE MANUFACTURE THEREOF

[75] Inventor: Roelof Terwel, Ommen, Netherlands

[73] Assignee: Sallmetall B.V., Raalte, Netherlands

[21] Appl. No.: 613,654

[22] PCT Filed: May 11, 1989

[86] PCT No.: PCT/NL89/00036

§ 371 Date: Jan. 10, 1991

§ 102(e) Date: Jan. 10, 1991

[87] PCT Pub. No.: WO89/10847

PCT Pub. Date: Nov. 16, 1989

[30] Foreign Application Priority Data

May 11, 1988 [NL] Netherlands ..... 8801246

[51] Int. Cl.[5] ..... B42D 15/00

[52] U.S. Cl. ..... 283/112; 283/107; 283/95

[58] Field of Search ..... 283/112, 107, 110, 77, 283/74, 94, 904, 95

[56] References Cited

U.S. PATENT DOCUMENTS 4,589,687 5/1986 Hannon .

FOREIGN PATENT DOCUMENTS 883741 10/1980 Belgium .
2129198 10/1972 France .
2145135 2/1973 France .

*Primary Examiner*—Timothy V. Eley
*Assistant Examiner*—Willmon Fridie, Jr.
*Attorney, Agent, or Firm*—Webb, Burden, Ziesenheim & Webb

[57] ABSTRACT

The invention relates to a laminated identity card, comprising a photographic emulsion layer intended for identity information which is adhered on both sides to a covering layer and to a method for the manufacture of this laminated identity card, comprising the steps for: a) the provision of a photographic emulsion layer intended for identity information; b) the adhesion of a first covering layer to the one surface of the photographic emulsion layer; and c) the adhesion of a second covering layer to the other surface of the photographic emulsion layer.

10 Claims, 2 Drawing Sheets

LAMINATED IDENTITY CARD AND A METHOD FOR THE MANUFACTURE THEREOF

The present invention relates to a laminated identity card, in particular intended for inclusion in a passport, and a method for the manufacture of such a laminated identity card.

A known laminated identity card is shown in FIG. 1. The identity card 1 consists of a top covering layer 2 which is fixed using an adhesive layer 3 to a photographic emulsion layer 4 provided with identity information and arranged on a bearing layer 5. The other, bottom covering layer 6 is fixed to the bearing layer 5 using an adhesive layer 7. In other words, the top covering layer 2 is adhered to the emulsion layer 4 and the bottom covering layer 6 is adhered to the bearing layer 5. A drawback of this known identity card 1 is that there is a difference in adhesive strength between the adhesion of the top covering layer of the emulsion layer and that of the bottom covering layer on the bearing layer, with the result that the different layers can be easily separated from each other without damage. By means of corona treatment or by flame treatment a reduction of the difference in adhesive strength can be achieved in the case of cold delamination because damage then occurs in the photographic emulsion layer. In the case of hot delamination there is hardly any improvement.

The invention has for its object to improve the known laminated identity card in the sense that under all circumstances when delamination takes place damage to the photographic emulsion layer occurs, as a result of which this card is notably more difficult to falsify. This is achieved according to the invention in that the laminated identity card according to the invention comprises an emulsion layer intended for identity information which is adhered on both sides to a covering layer.

The invention is based on the insight that, as a result of omitting the bearing layer for the photographic emulsion layer, both outer covering layers are adhered to the photographic emulsion layer with substantially the same adhesive strength, with the result that on delamination the photographic emulsion layer remains partly adhered to the top covering layer and partly to the bottom covering layer end is consequently irreparably damaged. In addition the cohesion in the photographic emulsion layer must thereby be smaller than the adhesion between each of the adhesive layers and the photographic emulsion layer. This identity card according to the invention is thus optimally protected against falsification.

An additional advantage is that through the absence of the bearing layer the stiffness and strength of the laminated identity card is reduced which results in it becoming more flexible and less damage being caused as a consequence of bending or folding.

The invention further relates to a method for the manufacture of a laminated identity card according to the invention, which method comprises the steps for a) the provision of a photographic emulsion layer intended for identity information;

b) the adhesion of a first covering layer to the one surface of the photographic emulsion layer; and c) the adhesion of a second covering layer to the other surface of the photographic emulsion layer.

In principle it is possible for the photographic emulsion layer to be arranged on the bottom covering layer which then functions temporarily as bearing layer. However it is advantageous to use photographic material that in principle is available on the market so that, after applying the top covering layer on the photographic emulsion layer, the bearing layer must first be removed prior to application of the bottom covering layer. The removal of the bearing layer can be carried out easily if use is made of photographic paper with an emulsion easily separable from the bearer (paper or plastic foil).

Mentioned and other features of the laminated identity card and its method of manufacture are described in the description following hereafter of a non-limitative embodiment, while reference is made to the annexed drawing.

Figure 1:
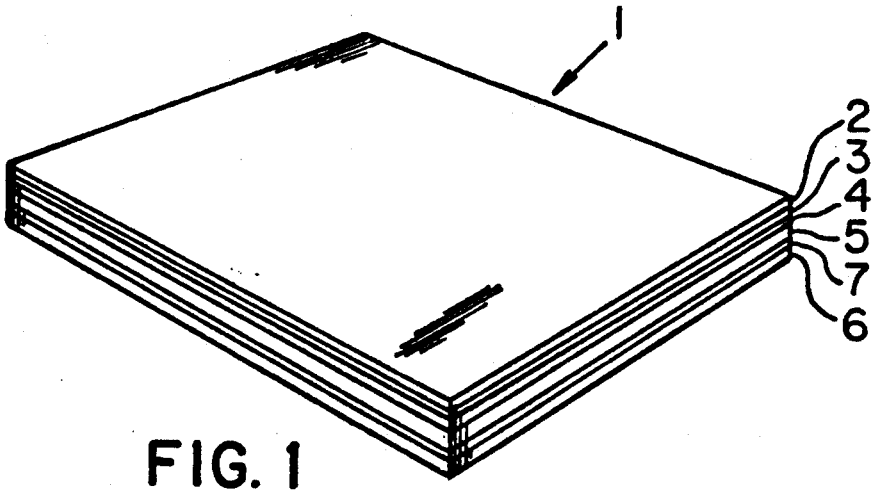
FIG. 1 shows a perspective view of a known identity card.
Figure 2:
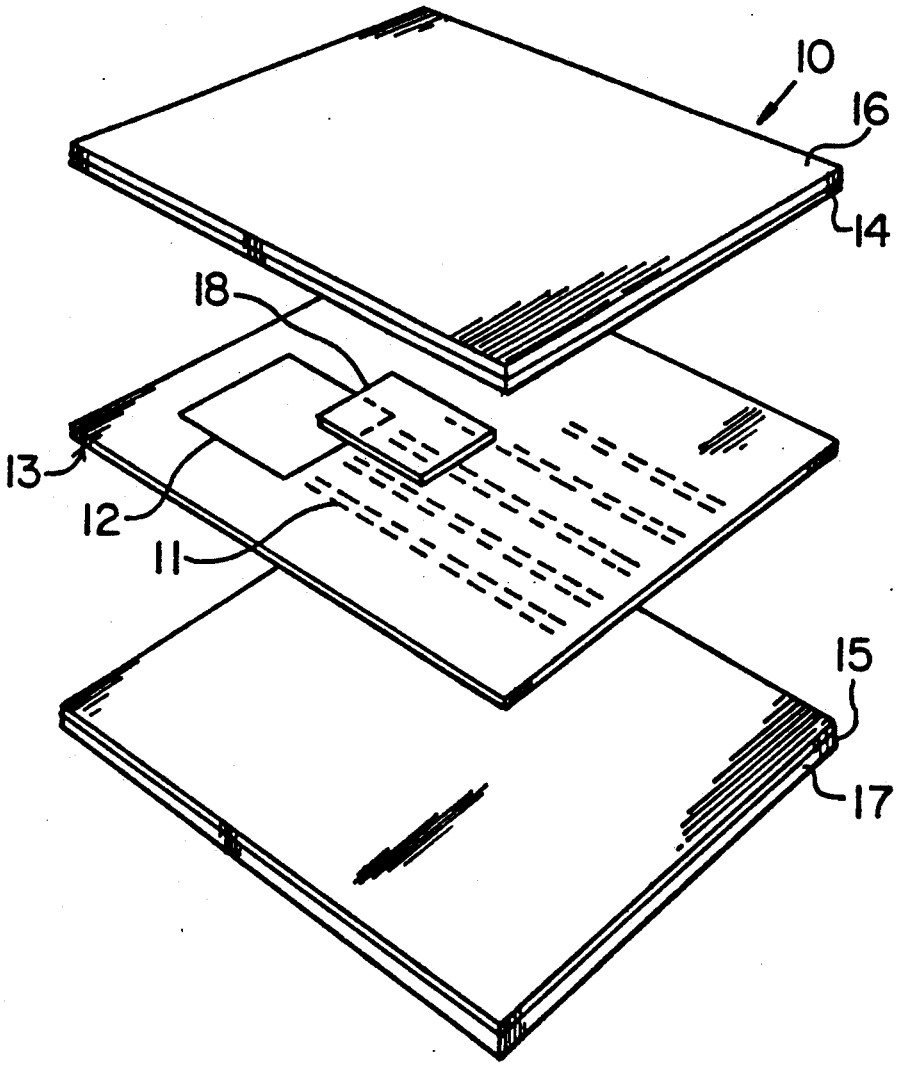
FIG. 2 is a perspective exploded view of an identity card according to the invention.
Figure 3:
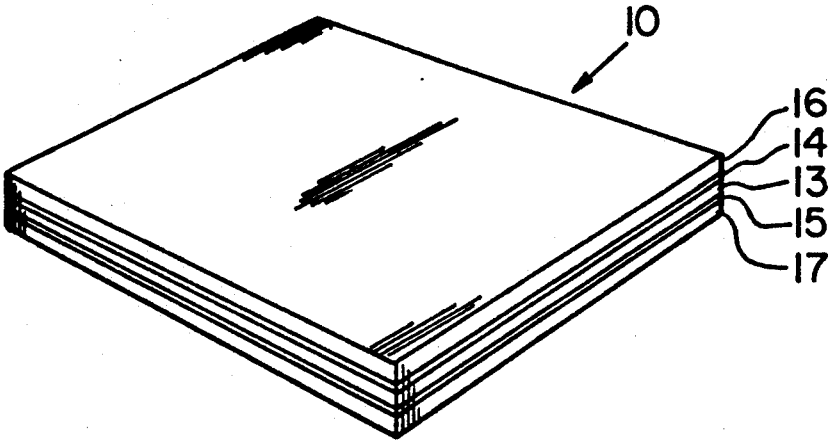
FIG. 3 is a perspective view of the identity card according to the invention.

The identity card 10 according to the invention consists of a photographic emulsion layer 13 provided with identity information 11 and 12, which layer is adhered through the interpositioning of adhesive layers 14 and 15 to the top covering layer 16 and the bottom covering layer 17 respectively (FIG. 3). By adhesive layer is understood a layer of adhesive agent whereof the adhesion for the photographic emulsion layer is greater than the cohesion in the photographic emulsion layer.

The top covering layer 16 is for example manufactured from a transparent polyester which is provided on one side with an adhesive layer 14 consisting of polythene.

The bottom covering layer 17 of a white opaque polyester can for the purpose of contrast be provided with a pattern (not shown) and is likewise provided on one side with a polyethylene adhesive layer 15.

The photographic emulsion layer comprises personal information 11 photographically formed therein and a pass photo 12 which are both partly covered in the known manner by a separate watermark seal 18.

Figure 4:
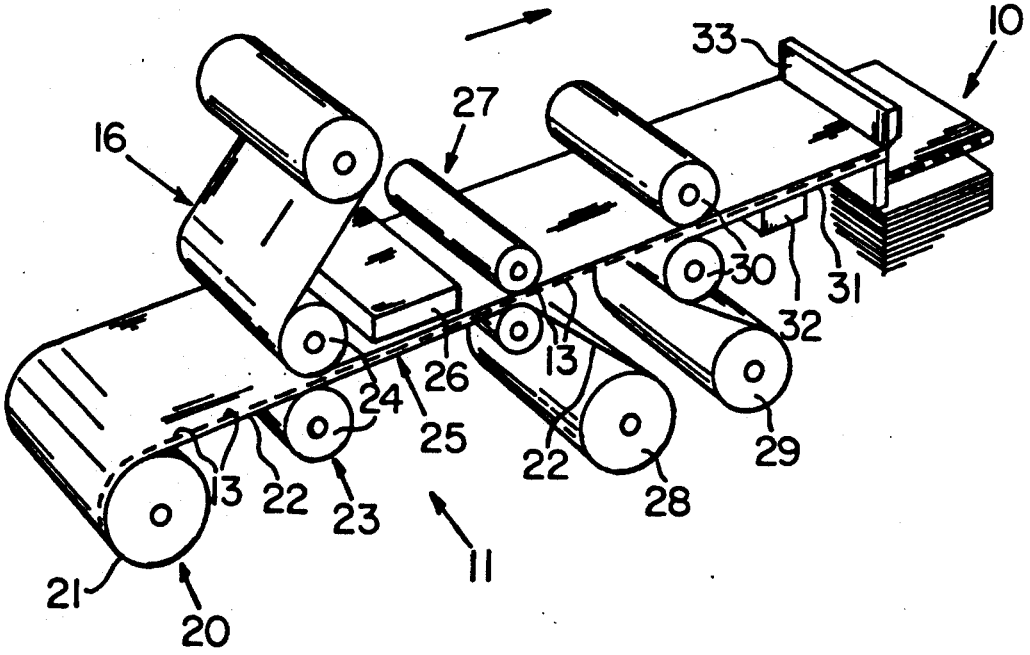
FIG. 4 shows schematically an apparatus for the manufacture of the identity card according to the invention.

FIG. 4 shows a schematically illustrated apparatus 19 for the manufacture of the identity cards 10 according to the invention.

The apparatus 19 comprises a feed station 20 in which is arranged a roll 21 of successive photographic emulsion layers 13 applied to a common bearing layer.

In a first lamination station 23 the top covering layer 16 is applied on the photographic emulsion layers 13 using a pair of heated rollers 24 (lamination temperature c. 130° C.).

After cooling of the laminate of the laminate 25 using a cooling unit 26 the bearing layer 22 is removed from the photographic emulsion layers 13 in a delamination station 27 and taken up on a roll 28.

In a second lamination station the bottom covering layer 17 is then applied against the photographic emulsion layers 13 using a pair of heated rollers 30. Finally, the formed laminate 31 is cooled using a cooling unit 32.

The thus formed path of successive laminated identity cards according to the invention with mutually differing identity information in the photographic emulsion layer can be taken up on a roll or cut to size and stacked using a cutting unit 33. The formed identity cards 10 according to the invention can subsequently be processed into a passport book.

It is possible within the scope of the invention to use a photographic emulsion which is directly applied with an adhesive layer to a bearing foil which also functions as covering layer. For this bearing foil and its adhesive layer the same requirements apply as for the covering layer.

As photographic material use can be made for instance of Scotch 575 from 3M, which photographic material comprises an opaque photographic emulsion which is easily separable from its bearer after exposure and printing.

I claim:

1. A laminated identity card, comprising a photographic emulsion layer intended for identity information;

a top covering layer adhered to said photographic emulsion layer;

a bottom covering layer adhered to said photographic emulsion layer; and an adhesive layer positioned between at least one of said top covering layer and said bottom covering layer, wherein said adhesive layer is an adhesive agent whereof the adhesion for said photographic emulsion layer is always greater than the cohesion in the photographic emulsion layer.

2. Identity card as claimed in claim 1, in which the photographic emulsion layer is adhered via said adhesive layer to a top transparent covering layer.

3. Identity card as claimed in claim 1, in which the bottom covering layer is of a colour contrasting with the emulsion layer.

4. Identity card as claimed in claim 1, in which the covering layers are manufactured from polyester.

5. Identify card as claimed in claim 2, in which the adhesive layer is manufactured from polyethylene.

6. A method for the manufacture of a laminated identity card, comprising the steps of:

a) providing a photographic emulsion layer intended for identity information;

b) providing an adhesive layer wherein said adhesive layer is an adhesive agent whereof the adhesion for said photographic emulsion layer is always greater than the cohesion in the photographic emulsion layer;

c) adhering a first covering layer to one surface of said photographic emulsion layer; and d) adhering a second covering layer to another surface of said photographic emulsion layer.

7. Method as claimed in claim 6, wherein in step a) the photographic emulsion layer is provided on a bearing layer and wherein after step b) and prior to step c) said bearing layer is removed.

8. Method as claimed in claim 6, in which each covering layer is made from polyester.

9. Method as claimed in claim 7, in which the adhesive layers are manufactured from polyethylene.

10. Method as claimed in claim 7, in which the covering layers are adhered to the photographic emulsion layer by hot lamination.

* * * * *